United States Patent [19]

Krieger

[11] Patent Number: 4,604,805

[45] Date of Patent: Aug. 12, 1986

[54] HOLDER FOR DETACHABLE BLADES

[75] Inventor: George H. Krieger, Creve Coeur, Mo.

[73] Assignee: John F. Cuscovitch, East Hartford, Conn.

[21] Appl. No.: 561,165

[22] Filed: Dec. 14, 1983

[51] Int. Cl.[4] ..... B26B 5/00

[52] U.S. Cl. ..... 30/330; 30/125; 30/331; 30/329

[58] Field of Search ..... 30/330, 331, 294, 329, 30/153, 262, 332, 333, 125; 145/62, 64

[56] References Cited

U.S. PATENT DOCUMENTS

| | | | |
|---|---|---|---|
| 3,604,113 | 9/1971 | Cuscovitch | 30/337 X |
| 3,829,967 | 8/1974 | Gilbert | 30/125 X |
| 3,872,591 | 3/1975 | Quenot | 30/125 X |
| 3,927,473 | 12/1975 | Braginetz | 30/125 X |
| 4,068,375 | 1/1978 | Rathbun et al. | 30/125 |
| 4,261,104 | 4/1981 | Cuscovitch | 30/331 X |

*Primary Examiner*—E. R. Kazenske
*Assistant Examiner*—Willmon Fridie, Jr.
*Attorney, Agent, or Firm*—McCormick, Paulding & Huber

[57] ABSTRACT

A holder for a detachable blade has a handle part and a blade retaining part formed by a pair of body sections pivotally connected for movement between open and closed positions. A latch member supported within the hollow handle part, and which retains the body sections in closed position, is released by manually operating an associated push button disposed in an aperture in the handle part. Coengageable clamping surfaces on the blade retaining part cooperate in clamping engagement to retain a blade in the holder when the holder is closed. A thumb rest on the blade retaining part reduces risk of accidental contact with a blade secured in the holder.

20 Claims, 19 Drawing Figures

HOLDER FOR DETACHABLE BLADES

BACKGROUND OF THE INVENTION

This invention relates in general to cutting tools and deals more particularly with an improved holder for detachable blades. The tool of the present invention may be used as a utility knife or general purpose cutting tool, but is particularly adapted for use as a carpet installation tool.

Holders for detachable blades are well known in the art and typical holders of the type with which the present invention is concerned are illustrated and described in U.S. Patents to Cuscovitch, U.S. Pat. No. 3,604,113, issued Sept. 4, 1971 and U.S. Pat. No. 4,261,104, issued Apr. 14, 1981. Each of the blade holders illustrated and described in the aforementioned U.S. patents is adapted to hold a double edged, apertured blade and has elongated pivotally connected body portions movable relative to each other between open and closed positions. When the holder is open a blade may be attached to or removed from it. When the holder is in its closed or working position the blade is retained in fixed position in the holder.

The blade holder shown in the earlier aforementioned U.S. patent has a latch member pivotally connected to one of its body sections by a relatively short pivot pin. This latch member is prone to loosen from repeated use and generally lacks desired blade retention capability. The improved blade holder shown in the later issued patent to Cuscovitch has a ball detent mechanism for releasably retaining its body sections in closed position. However, the latter arrangement is not entirely satisfactory, because it does not positively secure the body sections in closed position. Further, the double-edged blade used in a holder of the aforedescribed general type has an edge exposed at the upper side of the holder beyond the tip of the holder and presents a potential source of hand or finger injury to the user.

It is the general aim of the present invention to provide an improved holder for detachable blades such as aforedescribed which includes improved means for positively retaining the body sections of the holder in closed or blade retaining position, but allows quick release, so that the holder may be opened to facilitate rapid blade change, when required. A further aim of the present invention is to provide a holder for a detachable blade having an improved blade retention arrangement and including an improved safety feature to reduce risk of accidental finger contact with a blade edge when the holder is in use.

SUMMARY OF THE INVENTION

In accordance with the present invention an improved holder for a detachable blade comprises an elongated handle portion and a blade retaining portion which extends from the handle portion and terminates at a tip. The holder includes two relatively movable body sections connected for pivotal movement about an axis which extends transversely of the holder between an open position wherein the blade is detachable from the holder and a closed position wherein the blade is retained in fixed position in the holder. The body sections have opposing surfaces which are disposed in mating engagement in the closed position. A latch mechanism for releasably retaining the body sections in closed position includes a latch member supported on one of the body sections for movement between latching and releasing positions relative to the other of the body sections. The latch member has a manually operated actuator which is disposed within an aperture in the holder and which is operable to move the latch member from its latching to its releasing position. The blade retaining portion of the holder is preferably downwardly inclined from the handle portion in the direction of the tip and carries an upwardly projecting thumb rest adapted to prevent accidental thumb contact with the blade when the tool is in use. A lip on each blade retaining portion cooperates with the other blade retaining portion to secure a blade in fixed position within the holder.

DETAILED DESCRIPTION OF PREFERRED EMBODIMENT

Figure 1:
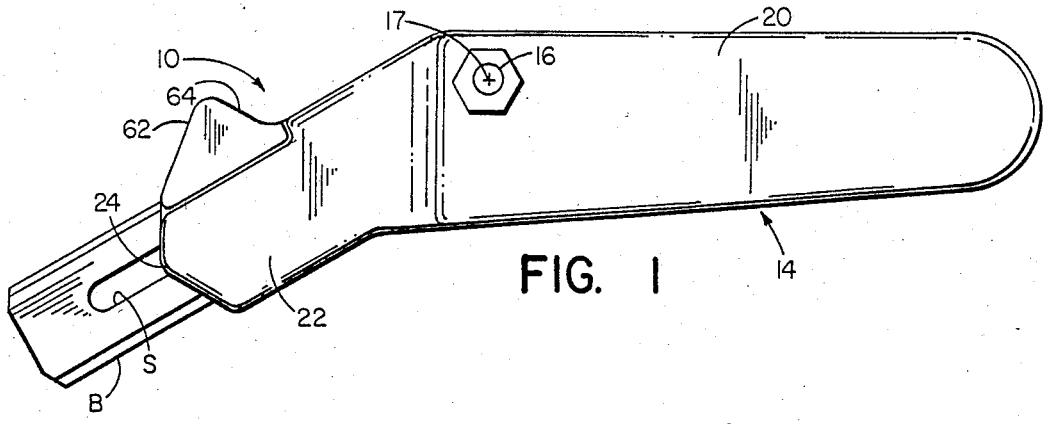
FIG. 1 is a side elevational view of a holder for a detachable blade embodying the invention.
Figure 2:
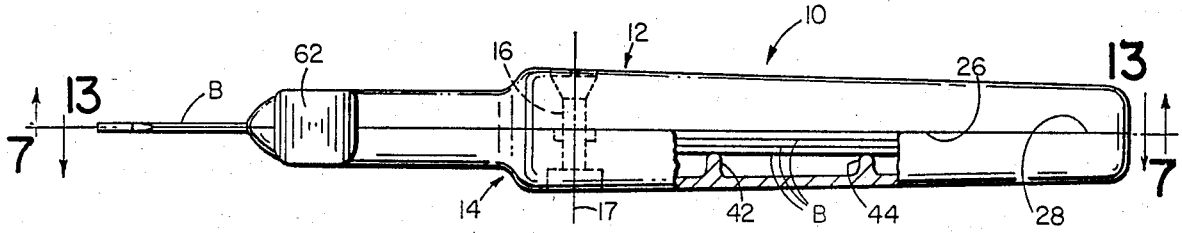
FIG. 2 is a top plan view of the holder of FIG. 1 shown partially in section.
Figure 3:
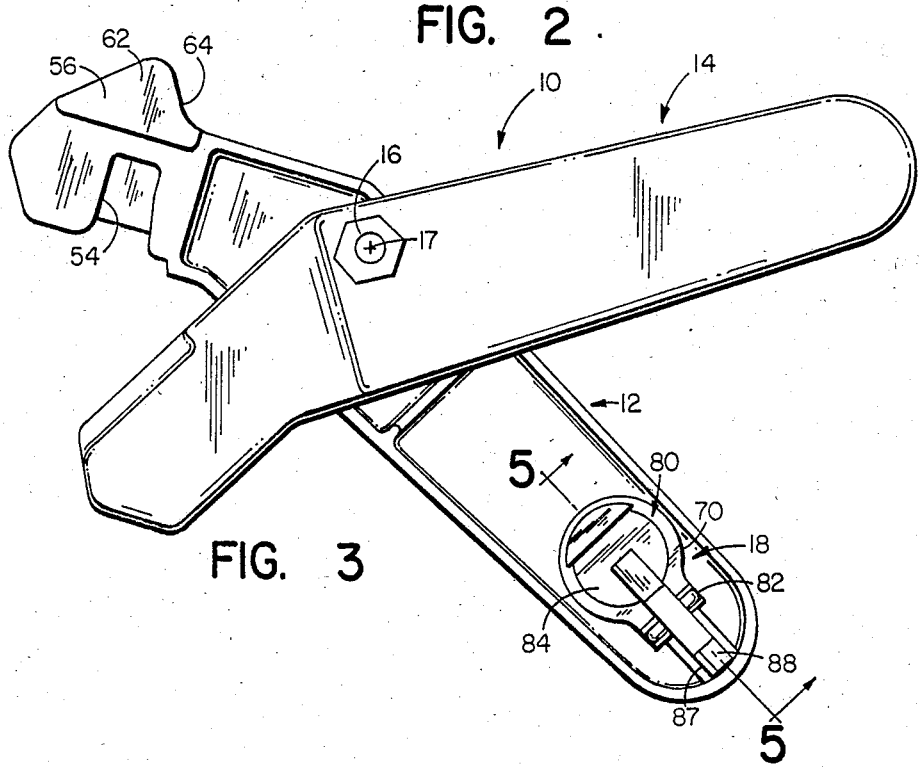
FIG. 3 is a side elevational view and shows the holder in an open position.

Turning now to the drawings, and referring first particularly to FIGS. 1-6, a holder for a detachable blade embodying the present invention is indicated generally by the reference numeral 10. In FIGS. 1 and 2 the holder 10 is shown with a double-edged apertured blade B releasably retained therein. The illustrated holder and blade assembly is suitable for use as a general purpose cutting tool, but is particularly adapted for use as a carpet installation tool. The double-edged blade B has an elongated aperture or slot, indicated at S, and may be reversibly positioned within the holder 10 to expose either of the blade edges in a cutting position, as will be hereinafter evident.

The holder 10 generally comprises a pair of body sections which includes a righthand section, indicated generally at 12, and a lefthand section, designated generally by the numeral 14. The sections 12 and 14 are connected together by a threaded fastener 16. The body sections pivot about an axis 17 which extends transversely of the holder, between open or blade receiving positions, such as the position shown in FIG. 3 and a closed or blade retaining position, shown in FIGS. 1 and 2. A latching mechanism, indicated generally at 18, releasably retains the body sections in closed position, as will be hereinafter further discussed. In the closed position the body sections 12 and 14 cooperate to define an elongated handle part 20 and a blade retaining part 22 which is inclined forwardly and downwardly from the handle part and terminates at a tip 24, as best shown in FIG. 1.

Figure 14:
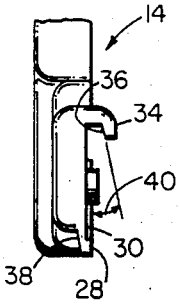
FIG. 14 is a fragmentary front view of the lefthand body section shown in FIG. 13.
Figure 15:
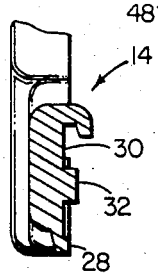
FIG. 15 is a sectional view taken along the line 15—15 of FIG. 13.
Figure 16:
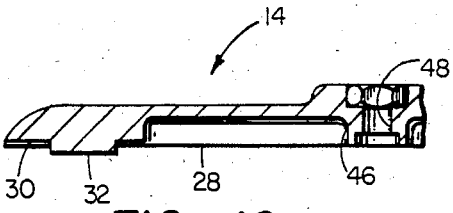
FIG. 16 is a somewhat enlarged fragmentary sectional view taken along the line 16—16 of FIG. 13.

Considering the holder 10 in further detail, the right and left hand body sections 12 and 14 are preferably diecast parts and have opposing inner surfaces indicated at 26 and 28, respectively, which are disposed in mating engagement within a common plane when the holder 10 is in closed position, as best shown in FIG. 2. The body section 14, shown in detail in FIGS. 13–16, has a shallow forwardly opening recess 30 in its blade retaining portion, the latter portion being designated by the numeral 31. The recess 30 has a width approximately equal to the width of the blade B and a depth approximately equal to the thickness of the blade. A blade mounting projection 32, integrally formed on the blade retaining portion of the body section 14 projects from the recess 30 inwardly and beyond the inner surface 28, as best shown in FIGS. 14–16. The mounting projection 32 is shaped to complement at least a portion of the slot S and is preferably sized to allow the blade B to be moved forwardly and rearwardly within the recess 30 when the holder 10 is in its opened position, so that projection of the blade B beyond the tip 24 may be adjusted, as desired.

An integral lip 34 formed on the blade retaining portion of the body section 14 extends laterally outward beyond the inner surface 28 and along the lower edge of the blade retaining portion. The lip 34 defines an inwardly facing clamping surface 36 which preferably forms an angle of approximately 15 degrees with the plane of the inner surface 28, as best shown in FIG. 14, where the latter angle is indicated by the numeral 40. The blade retaining portion of the body section 14 is relieved along its upper margin and defines an outwardly facing clamping surface 38 for generally complimentary coengagement with an associated inwardly facing clamping surface on the other body section 12 when the holder is closed, as will be hereinafter further discussed.

Figure 13:
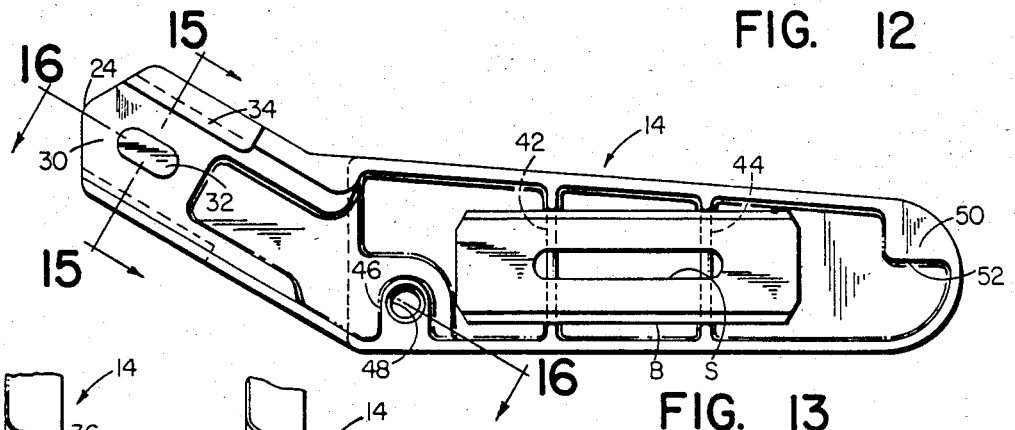
FIG. 13 is a side elevational view of the lefthand body section as viewed along the line 13—13 of FIG. 2.

The handle portion of the body section 14 is hollow and has ribs 42 and 44 therein which extend transversely thereacross and are recessed to define a storage compartment for extra blades, as best shown in FIGS. 2 and 13. An integral boss 46 is formed within the hollow handle portion of the body section 14 proximate the junction of the handle portion and the blade retaining portion and has a stepped bore 48 for receiving an associated portion of the fastener 16. The bore 48 extends transversely through the body section 14, as shown in FIGS. 13 and 16. The outer end of the bore 48 has a hexagonal configuration for receiving a nut, which comprises part of the fastener 16. Another boss 50 within the rear end of the handle portion 14 defines a strike surface 52 which cooperates with the latch mechanism 18, as will be hereinafter further discussed.

The righthand body section 12, shown in detail in FIGS. 7–12, has a recess 54 in its blade retaining portion which opens inwardly and downwardly for receiving an associated portion of the mounting projection 32 when the holder 10 is in its closed position. A lip 56 projects outwardly from the blade retaining portion beyond the inner surface 26 and defines an inwardly facing clamping surface 58 which forms an angle of approximately 15 degrees with the inner surface 26, the latter angle being indicated by the numeral 60 in FIG. 8. The blade retaining portion of the body section 12 is relieved along its lower margin and defines an outwardly facing clamping surface 61 for generally complementary coengagement with the clamping surface 36 on the opposite body portion 14 when the holder 12 is in its closed position.

Figure 11:
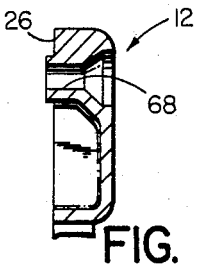
FIG. 11 is a fragmentary sectional view taken along the line 11—11 of FIG. 7.
Figure 10:
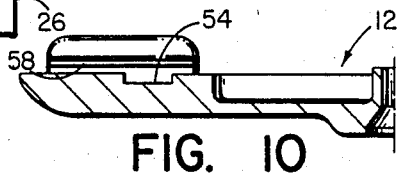
FIG. 10 is a sectional view taken along the line 10—10 of FIG. 7.

The body section 12 has an integral upwardly projecting thumb rest 62 which defines a generally rearwardly facing surface 64 on the upper part of its blade retaining portion between its tip and its handle portion. The handle portion of the body section 12 is hollow and has an integral boss 66 therein proximate the junction between the handle portion and the blade retaining portion. The inner end of the boss projects inwardly beyond the surface 26, as shown in FIG. 11, and is sized to be received within the counterbore at the inner end of the bore 48. A bore 68 extends through the boss 66 for receiving an associated portion of the fastener 16 and is countersunk at its outer end to receive the head of the fastener 16.

Figure 5:
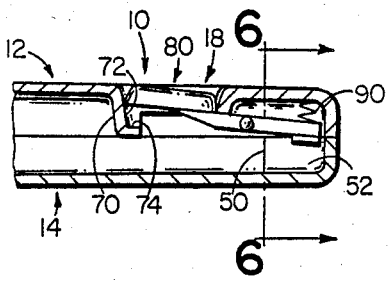
FIG. 5 is a sectional view taken generally along the line 5—5 of FIG. 3.
Figure 6:
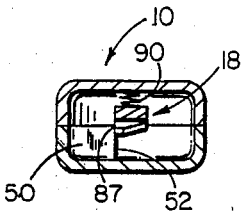
FIG. 6 is a sectional view through the holder in closed position taken along the line 6—6 of FIG. 5.
Figure 7:
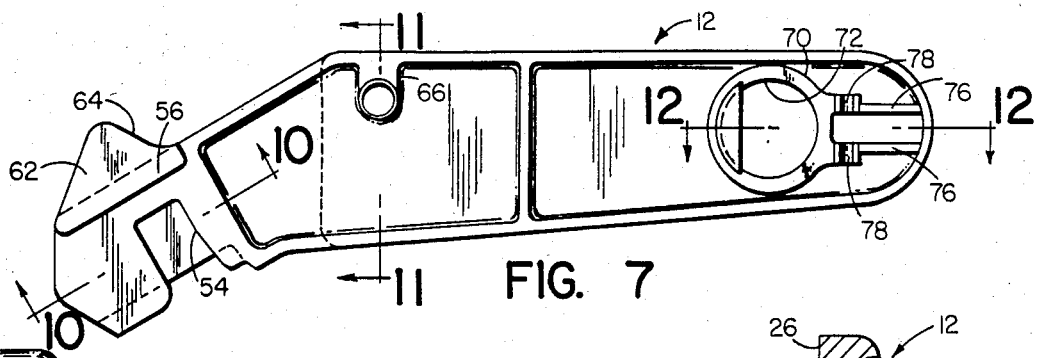
FIG. 7 is a side elevational view of the right hand body section as viewed along the line 7—7 of FIG. 2.
Figure 8:
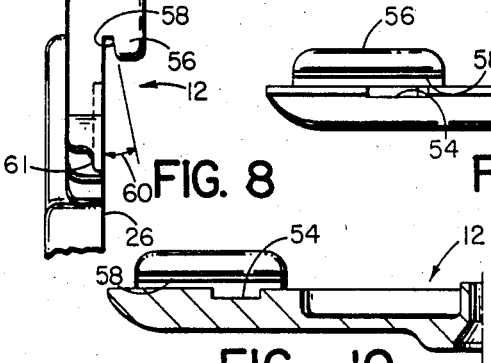
FIG. 8 is a fragmentary front elevational view of the righthand body section as shown in FIG. 6.
Figure 9:
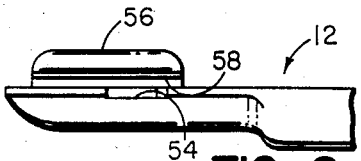
FIG. 9 is a fragmentary bottom view of the righthand body section.
Figure 12:
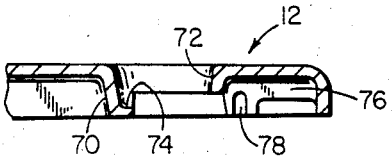
FIG. 12 is a fragmentary sectional view taken along the line 21-12 of FIG. 7.

A generally cylindrical inwardly projecting boss 70 is formed within the rear portion of the handle section 12 and defines an aperture 72 which opens outwardly through the body section. An outwardly facing seating surface 74 is formed within the aperture 72 at the forward inner end of the boss 72, as best shown in FIGS. 5 and 12. A pair of laterally spaced apart parallel ribs 76, 76 extend rearwardly from the circular boss 70 to the rear wall of the handle portion 12 and have generally U-shaped inwardly opening fulcrum recesses 78, 78, formed therein, as best shown in FIGS. 7 and 12.

Figure 17:
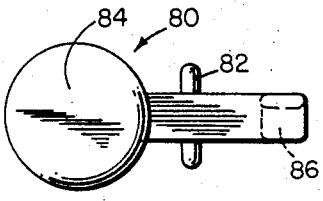
FIG. 17 is a somewhat enlarged side elevational view of the latch member.
Figure 18:
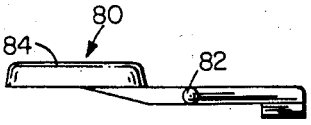
FIG. 18 is a plan view of the latch member.
Figure 19:
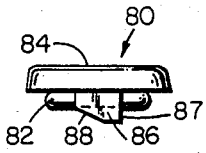
FIG. 19 is an end view of the latch member.

The latch mechanism 18 includes a latch lever, indicated generally at 80 and best shown in FIGS. 17–19. The latch lever is preferably die cast and is supported for pivotal movement about an axis which extends transversely of the longitudinal axis of the handle part 20. It includes an integral pivot pin 82 which is received and supported in the fulcrum recesses 78, 78. A push button portion 84 at one end of the latch lever 80 is received within the aperture 72. An integral latching element 86 at the opposite end of the latch lever includes a latch surface 87 for latching engagement with the strike surface 52. An inclined cam surface 88 on the latch element 86 is adapted to engage an edge portion of the body section 14 which cams the latch lever 80 into the recess within the body section 12 when the body sections are pivoted relative to each other and to the closed position. A biasing spring 90 disposed in a recess between the ribs 76, 76 and shown in FIG. 5 acts between the body section 12 and the latch lever 80 to normally bias the latch lever toward its latching position.

Figure 4:
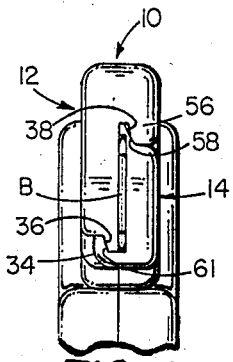
FIG. 4 is a fragmentary front elevational view of the holder in closed position.

When the holder is in its closed position the coengageable clamping surfaces 38, 58 and 36, 61 are respectively engaged to retain the blade B in the holder 10, as shown in FIG. 4. In the closed position the latch surface 87 is engaged with the strike surface 52 and positively retains the blade holder 10 in its closed position. The latch lever 80 may be readily released from its latching position by manually depressing the push button 84, which allows the holder to be opened for blade adjustment, removal and replacement.

I claim:

1. In a holder for a detachable blade and having a body including a pair of mating body sections having marginal portions for engagement within a common plane, each of the body sections having a handle portion and a blade retaining portion, pivot means connecting the body sections for pivotal movement about an axis generally normal to the common plane between an open position wherein a blade may be inserted into and removed from the holder and a closed position wherein the blade retaining portions cooperate to define blade retaining means for securing a blade in a cutting position in the holder, and latching means for releasably securing said body sections in closed position, the improvement comprising said blade retaining means including a laterally outwardly facing first clamping surface defined by a marginal portion of the outer peripheral surface of each of said blade retaining portions and a lip carried by each of said blade retaining portions and extending laterally therefrom beyond said common plane and in the direction of the other of said blade retaining portions and defining a laterally inwardly second facing clamping surface, said second clamping surface on each of said blade retaining portions engaging said first clamping surface on the other of said blade retaining portions when said body sections are in said closed position.

2. In a holder for a detachable blade as set forth in claim 1 the further improvement wherein the body sections are disposed in mating engagement within a common plane when the holder is in its closed position and each said clamping surface is inclined relative to said common plane.

3. In a holder for a detachable blade as set forth in claim 2 the further improvement wherein the plane of each of the clamping surfaces is substantially parallel to the plane of the other of the clamping surfaces when the holder is in said closed position.

4. In a holder for a detachable blade and having an elongated body including a pair of mating body sections, each of the body sections having a handle portion and a blade retaining portion extending from said handle portion, pivot means connecting the body sections for pivotal movement about an axis extending transversely of said body and disposed in fixed position relative to said body between an open position wherein a blade may be inserted into and removed from the holder and a closed position wherein the handle portions cooperate to define an elongated handle part and the blade retaining portions cooperate to define a blade retaining part forming a junction, with the handle part and having retaining means for securing a blade in a cutting position in the holder, said pivot means connecting said body sections proximate said junction, and manually operable latching means movable between latching and releasing positions for releasably securing said body sections in closed position when said latching means is in its latching position, the improvement comprising said latching means including a latch member and means for supporting said latch member within said handle part and longitudinally spaced from said axis, one of said handle portions having an aperture therein, said latch member including a manually operable actuator button disposed within said aperture and accesible externally of said one handle portion for operating said latch member to move said latch member to its releasing position.

5. In a holder for a detachable blade as set forth in claim 4 the further improvement comprising biasing means for urging said latch member toward said latching position.

6. In a holder for detachable blades as set forth in claim 4 the further improvement wherein said latch member is supported within said one handle portion and includes a latch element and the other of said handle portions defines a strike surface engaged by said latch element in said latching position.

7. A holder for a detachable blade and comprising a body having an elongated handle part and a blade retaining part projecting from said handle part, said body including a pair of body sections, each of said body sections having a handle portion and a blade retaining portion, each of said body sections having a lip on its blade retaining portion defining an associated inwardly facing clamping surface, fastener means connecting the body sections proximate the junction of said handle part and said blade retaining part for pivotal movement between an open position wherein a blade may be inserted into and removed from said holder and a closed position wherein a blade may be secured in said holder by said blade retaining part, said body sections in said closed position being disposed in mating engagement within a common plane, said clamping surface on each one of said body sections clampingly engaging an associated clamping surface on the other of said body sections when said holder is in its closed position, latching means for releasably securing said body sections in said closed position and including a latch lever having a latch element at one end and a manually operated push button at its opposite end, fulcrum means on one of said body sections supporting the latch lever within the handle portion of said one body section for pivotal movement about an axis extending transversely of the longitudinal axis of said handle part between latching and releasing positions, an aperture in said handle portion of said one body section receiving said push button, said push button being exposed within said aperture and externally of said handle part, biasing means acting between said one body section and said latch lever for urging said latch member toward its latching position relative to said one body section, and a strike surface defined by said handle portion of the other body section and engaged by said latch element when said holder is in said closed position to releasably retain said holder in said closed position.

8. A holder for a detachable blade as set forth in claim 7 wherein each of the clamping surfaces is inclined relative to said common plane when said holder is in its closed position.

9. A holder for a detachable blade as set forth in claim 8 wherein the longitudinal axis of said blade retaining part is inclined downwardly and away from the longitudinal axis of said handle part.

10. A holder for a detachable blade as set forth in claim 9 including a thumb rest projecting upwardly from said blade retaining part and defining a generally rearwardly facing surface.

11. A holder for a detachable blade as set forth in claim 10 wherein said thumb rest is wholly defined by one of said body sections.

12. In a holder for a detachable blade and having a body including a pair of mating body sections, each of the body sections having a handle portion and a blade retaining portion, pivot means connecting the body sections for pivotal movement between an open position wherein a blade may be inserted into and removed from the holder and a closed position wherein the handle portions cooperate to define an elongated handle and the blade retaining portions cooperate to define blade retaining means for securing a blade in a cutting position in the holder, and latching means for releasably securing said body sections in closed position, the improvement comprising said latching means including a latch lever having a latch element at one end and an operating button at its opposite end and means supporting said latch lever within the handle portion of one of said body sections for movement within said handle between latching and releasing positions, said other of said body sections defining a strike engaged by said latch element in said latching position, said handle having an aperture therein, said operating button being disposed within said aperture and exposed externally of said handle for operating said latch lever.

13. In a holder for a detachable blades as set forth in claim 12 the further improvement wherein said supporting means comprises fulcrum means defined by the handle portion of said one body section and said lever is supported for pivotal movement about an axis extending transversely of the longitudinal axis of said handle.

14. In a holder for a detachable blade as set forth in claim 13 the further improvement comprising biasing means for urging said latch member toward said latching position.

15. In a holder for a detachable blade and having a body including a pair of mating body sections, each of the body sections having a handle portion and a blade retaining portion, means for connecting the body sections to pivot between an open position wherein a blade may be inserted into and removed from the holder and a closed position wherein the handle portions cooperate to define an elongated handle and the blade retaining portions cooperate to define blade retaining means for securing a blade in a cutting position in the holder, and latching means for releasably securing said body sections in closed position, the improvement comprising said latching means including a latch member and means for supporting said latch member on the handle portion of one of said body sections for movement within said handle between latching and releasing positions, said handle having an aperture therein, said latch member having a latch element at one end and a manually operable button at its opposite end disposed within said aperture and exposed externally of said handle for operating said latch member, and a strike surface defined by the handle portion of the other of said body sections for engagement by said latch element to retain said body sections in said closed position.

16. A holder for a detachable blade and comprising an elongated body having an elongated handle part and a blade retaining part extending from said handle part, said body including a pair of body sections, each of said body sections having a handle portion and a blade retaining portion, fasterner means for pivotally connecting the body sections to each other to pivot about an axis between an open position wherein a blade may be inserted into and removed from said holder and a closed position wherein associated portions of said body sections are in face-to-face relation to each other within a common plane and a blade may be retained in a cutting position with said holder, at least one of said blade retaining portions having an integral laterally projecting lip extending beyond said common plane and in the direction of the other of said blade retaining portions, said lip extending along a marginal portion of said one blade retaining portion and defining a first clamping surface for clampingly engaging another clamping surface defined by said other blade retaining portion to urge said blade retaining portions toward each other and into clamping engagement with an associated blade positioned between said blade retaining portions when said holder is in said closed position, and a latch member mounted in said handle part for movement between a latching position wherein said latch member cooperates with the handle portions of said body to retain said holder in said closed position and a releasing position wherein said handle portions are freely pivotally movable between said open and closed positions, one of said handle portions having an aperture therethrough, said latch member having an operating button exposed within said aperture for manual operation to move said latch member from its latching to its releasing position.

17. A holder for a detachable blade and comprising a holder body having an elongated handle part and a blade retaining part extending from said handle part, said body including a pair of body sections, each of said body sections having a handle portion and a blade retaining portion, fastening means for pivotally connecting the body sections in engagement with each other to pivot between an open position wherein a blade may be inserted into and removed from said holder and a closed position wherein associated portions of said body sections are disposed in face-to-face relation to each other in a common plane and a blade may be retained in a cutting position within said holder, and a latch member mounted in said handle part for movement between a latching position wherein said latch member cooperates with the handle portions of said body to retain said holder in said closed position and a releasing position wherein said handle portions are free to pivot between said open and closed positions, one of said handle portions having an aperture therethrough, said latch member including an operating button exposed within said aperture for manual operation to move said latch member from its latching to its releasing position.

18. A holder for a detachable blade as set forth in claim 17 including a spring acting between said latch member and one of said handle portions.

19. A holder for a detachable blade as set forth in claim 18 wherein said fastening means connect said body sections proximate the junction of said handle part and said blade retaining part.

20. A holder for a detachable blade as set forth in claim 17 wherein said latch member is wholly disposed to one side of said plane when said latch member is in said releasing position and a portion of said latch member is disposed to the opposite side of said plane when said latch member is in its latching position.

* * * * *